US007358981B2

(12) United States Patent
Morita et al.

(10) Patent No.: US 7,358,981 B2
(45) Date of Patent: Apr. 15, 2008

(54) IMAGE FORMATION DEVICE AND IMAGE FORMATION METHOD

(75) Inventors: Tetsuya Morita, Hirakata (JP); Kenji Sasaki, Kyoto (JP); Toshiyuki Wada, Minoh (JP); Haruo Yamashita, Ibaraki (JP); Tsumoru Fukushima, Kyoto (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 414 days.

(21) Appl. No.: 10/528,519

(22) PCT Filed: Sep. 18, 2003

(86) PCT No.: PCT/JP03/11946

§ 371 (c)(1),
(2), (4) Date: Sep. 16, 2005

(87) PCT Pub. No.: WO2004/026585

PCT Pub. Date: Apr. 1, 2004

(65) Prior Publication Data

US 2006/0153591 A1 Jul. 13, 2006

(30) Foreign Application Priority Data

Sep. 20, 2002 (JP) ..... 2002-275933
Nov. 22, 2002 (JP) ..... 2002-340047

(51) Int. Cl.
*B41J 2/325* (2006.01)

(52) U.S. Cl. ..... 347/215

(58) Field of Classification Search ..... 347/171, 347/215, 216, 217, 220, 213, 188
See application file for complete search history.

(56) References Cited

U.S. PATENT DOCUMENTS 6,704,037 B1 * 3/2004 Taguchi ..... 347/213
6,842,186 B2 * 1/2005 Bouchard et al. ..... 347/188
6,908,239 B1 * 6/2005 Foster et al. ..... 400/120.02

FOREIGN PATENT DOCUMENTS

JP 2002-086776 A 3/2002

OTHER PUBLICATIONS

International Search Report for corresponding PCT/JP2003/011946, mailed Dec. 24, 2003.

* cited by examiner

*Primary Examiner*—K. Feggins
(74) *Attorney, Agent, or Firm*—Renner, Ott, Boisselle & Sklar, LLP

(57) ABSTRACT

In order to avoid a load change which occurs when seam O passes by the heads affect image information, a dyeing layer transfer head and recording heads are located in equal intervals having length P, which is obtained by equally dividing an entire circumference K of a recording intermediate belt by n (n is integer), and, given that the position of the seam of the recording intermediate belt, which does not have an end obtained by coupling two ends of a belt body of a band shape, is origin O, images are formed in portions except for portions at origin O, or at a distance of 1×P, 2×P, . . . (n−1)×P from origin O. In this way, it is possible to prevent deterioration in the image quality, such as a stripe line in an image formed by an image forming apparatus.

17 Claims, 8 Drawing Sheets

IMAGE FORMATION DEVICE AND IMAGE FORMATION METHOD

TECHNICAL FIELD

The present invention relates to an image forming apparatus and an image forming method for forming a full-color image on recording paper by a dye thermal transfer method.

BACKGROUND ART

One of image forming methods which can form an image having a high image quality comparable to the image quality of color pictures using a photograph development technique is a dye thermal transfer method (see, for example, Japanese Laid-Open Publication No. 2002-86776). The dye thermal transfer method is increasingly drawing attentions as digital cameras come into wide use since an image can conveniently formed based on digital image signals imaged by digital cameras.

In the dye thermal transfer method, a dyeing layer, for example, a resin having a high pigment dyeing property on a base material, and dyes such as yellow, magenta, and cyan are sequentially pressed on and dyes the dyeing layer. The dyeing layer dyed with dyes of respective colors to transferred to a surface of a recording paper, which is plain paper, by thermal transfer. Thus, a full-color image formed on the dyeing layer is formed on the recording paper.

In image forming apparatuses employing the dye thermal transfer method, a belt body, which is a band of a polyimide film is usually used. Two ends of belt body are connected to each other so as to obtain a recording intermediate belt which does not have an end. The recording intermediate belt loops around a platen drum having a cylindrical shape which is formed to be rotatable. Thus, the recording intermediate belt revolves at a predetermined rate as the platen drum rotates.

On an outer peripheral surface side of the platen drum, a dyeing layer formation section for forming a dyeing layer on an outer surface of the recording intermediate belt, a first image formation section for dyeing the dyeing layer with a dye of yellow color, a second image formation section for dyeing the dyeing layer with a dye of magenta color, and the third image formation section for dyeing the dyeing layer with a dye of cyan color are located in this order from an upper stream side of revolving of the recording intermediate belt. On the outer surface of the recording intermediate belt which revolves along the outer peripheral surface of the platen drum, first, a dyeing layer is formed at the dyeing layer formation section. Then, the dyeing layer is dyed with dyes of yellow, magenta, and cyan, respectively, at the first image formation section through the third image formation section. The first through third image formation sections include recording heads for dyeing respective dyes by pressing. The recording heads dyes the dyeing layer with respective dyes based on an image signal. As a result, a full-color image is formed on the dyeing layer.

The full-color image formed on the dyeing layer of the recording intermediate belt is transferred to the recording paper, which is plain paper, with the dyeing layer by thermocompression bonding to the recording paper pulled out from a recording paper roll wound into a roll, for example. Thereafter, the recording intermediate belt and the recording paper bonded via the dyeing layer are guided in different direction to separate the recording intermediate belt and the recording paper. The recording paper separated from the recording intermediate belt is out into pieces of predetermined size by a cutter and ejected out of the image forming apparatus.

In image forming apparatuses employing such a dye thermal transfer method, images are formed by sequentially performing the steps of forming a dyeing layer, dyeing with a dye of yellow color, dyeing with a dye of magenta color, and dyeing with a dye of cyan color while a recording intermediate belt looping around a platen drum revolves. Thus, images can be formed at a plurality of positions on the recording intermediate belt revolving around the platen drum at the same time. Thus, a time for forming images can be reduced when pieces of recording paper with images formed thereon are produced, thereby increasing the speed of image formation.

In the above-described dye thermal transfer method, the recording heads respectively provided in the first through third image formation sections press the recording intermediate belt for dyeing with dyes of the respective colors. Thus, images are formed. However, in the image forming apparatuses employing this dye thermal transfer method, there is a problem that, when the recording heads do not press the dyeing layer on the recording intermediate belt at the correct locations with correct pressing strength, distortion of images such as stripe lines on images occur, and definition of the images tend to deteriorate. Further, such distortions in the images may also be generated by load changes when the step of cutting the recording paper with the dyeing layer transferred thereto into pieces of a predetermined size by a cutter after it is removed from the recording intermediate belt is performed.

If image quality is deteriorated due to such image distortions, a plurality of images cannot be formed at the same time, and thus, the efficiency of image formation cannot be promoted.

Therefore, it is important to previously avoid factors which may deteriorate the definition of the images in order to stably form the high-definition images using the above-described image forming apparatuses.

Further, in the above-describe image forming apparatuses, if the size of images to be formed increases, a long time is required as image process operation time for generating a control signal for forming images. Due to the image process operation time, a blank image may be formed since the control signal cannot be in time to start image formation. Thus, the efficiency of image formation cannot be promoted.

The present invention is provided in view of such circumstances, and the object thereof is to provide an image forming apparatus and image forming method in which factors which may deteriorate the definition of images are previously avoided, and which can stably form images of a high definition and promote efficiency of image formation.

DISCLOSURE OF THE INVENTION

In order to solve the above-described problems, an image forming apparatus of the present invention comprises: a recording intermediate belt which does not have an end obtained by coupling two ends of a belt body of a band shape; a platen drum and at least one roller around which the recording intermediate belt loops so as to be revolvable: a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, the dyeing layer transfer head and the recording heads are located in equal interval of length P, which is obtained by equally dividing length K of the entire circumference of the recording intermediate belt by n (n is integer), the image formation section is formed, given that the position of a seam of the recording intermediate belt is origin O, to form an image in portions except for portions at origin O and at a distance of 1×P, 2×P, . . . (n−1)×P from origin O.

In the image forming apparatus of the present invention, it is preferable that image formation areas formed by transferring dyes by the image formation sections to the dyeing layer formed on the recording intermediate belt by the dyeing layer formation section, and image non-formation areas formed by not transferring dyes by the image formation sections are repeatedly formed, and the image non-formation areas between the image formation areas are formed such that length T along the revolving direction of the recording intermediate belt is larger than length R of the seam of the recording intermediate belt.

In the image forming apparatus of the present invention, it is preferable to comprise a separation roller for separating the recording intermediate belt and the recording paper which are thermocompression-bonded via the dyeing layer at the image transfer section, and that the separation roller is located at the position at a distance of m×P (m is integer) from the recording head of the image formation section in an upstream direction.

Further, an image forming method of the present invention to an image forming method for forming an image having a length longer than interval P between the dyeing layer transfer head and the recording heads by using the above-described image forming apparatus of the present invention, wherein: an image is formed on a surface of the recording intermediate belt during a plurality of cycles of revolving movement of the recording intermediate belt; and only a predetermined head of the dyeing layer transfer head and the recording heads presses the recording intermediate belt in each cycle of the revolving movement of the recording intermediate belt.

In the image forming method of the present invention, it is preferable that, for a plurality of cycles of the revolving movement of the recording intermediate belt, only the dyeing layer transfer head presses the recording intermediate belt in the first cycle of the revolving movement of the recording intermediate belt, and only the recording heads press the recording intermediate belt in the second cycle of the revolving movement of the recording intermediate belt.

Further, an image forming apparatus of the present invention comprises: a recording intermediate belt which does not have an end obtained by coupling two ends of a belt body of a band shape; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, a mark is printed near a seam of the recording intermediate belt, and detection means for detecting the mark is provided.

Further, an image forming method of the present invention is an image forming method using the above-described image forming apparatus of the present invention, wherein: when the detection means detects the mark, the dyeing layer transfer head or the recording heads which includes the detection means stops pressing the recording intermediate belt.

Further, an image forming apparatus of the present invention comprises: a recording intermediate belt which does not have an end obtained by coupling two ends of a belt body of a band shape; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolting direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, the recording intermediate belt revolves all the time even when it does not form an image, and a position of a seam of the recording intermediate belt is always detected, and image formation is started based on the detected results.

Further, an image forming apparatus of the present invention comprises: a recording intermediate belt which does not have an end obtained by coupling two ends of a belt body of a band shape; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and before an image formation operation is started, a seam of the recording intermediate belt, which does not have an end obtained by coupling two ends of a belt body of a band shape, is previously stopped at a position near the dyeing layer transfer head of the dyeing layer transfer section.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and a positional deviation from designed values of the recording heads in the plurality of the image formation sections are previously measured, and based on the measured results, compensation of recording timings of the recording head is performed so as to absorb the positional deviation from the designed values.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and relationships between pressing states of the recording heads of the recording intermediate belt and amounts of shift in recording positions due to small changes caused by being pressed by the recording heads are previously measured, and based on the measured results, compensation of recording timings of the recording heads is performed.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and compensation of recording timings of the recording heads is performed in accordance with amounts of shift in recording positions of the recording heads of the image formation sections corresponding to a change in a rotation rate of the platen drum.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt by thermocompression bonding; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; an image transfer section for transferring the dyeing layer on which an image of the image formation sections is formed to recording paper by thermocompression bonding; a separation roller which is provided downstream of the image transfer section in the revolving direction of the recording intermediate belt, and which guides the recording intermediate belt and the recording paper, which are pressure-bonded to each other via the dyeing layer and moving, in different directions to separate the recording intermediate belt and the recording paper from each other; and cutting means for cutting the recording paper guided in a different direction from the recording intermediate belt by the separation roller into color images which have been formed, wherein the cutting means is located such that the recording paper bends to an extent to absorb a cutting shock generated when the recording paper is cut by the cutting means.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt by thermocompression on bonding; a plurality of image formation sections which are located downstream of the dyeing layer formation section in the revolving direction of the recording intermediate belt, and which transfer dyes of different colors to the dyeing layer formed on the outer surface of the recording intermediate belt to form a color image, an image transfer section for transferring the dyeing layer on which an image of the image formation sections is formed to recording paper by thermocompression bonding; and a control section for outputting control signals for respectively controlling the image formation sections based on an input image signal which has been input, wherein the control section calculates a processing time of an input image signal which is input for each of images to be formed when images are formed continuously, and, based on the calculated results, sets an order for forming the images.

In the image forming apparatus of the present invention, it is preferable that the control section sets an order for forming images such that images having processing times for input image signals which are input are longer than a pre-set reference value are not continuously formed.

In the image forming apparatus of the present invention, it is preferable that the control section performs based on calculated results of calculation on a processing time of an input image signal which is input, a process of input image signal of an image having a processing time for an input image signal longer than a pre-set reference value before forming an image.

Further, an image forming apparatus of the present invention comprises: a recording intermediate belt which does not have an end; a platen drum and at least one roller around which the recording intermediate belt loops so as to be revolvable; a dyeing layer formation section for forming a dyeing layer on an outer surface of the revolving recording intermediate belt by thermocompression bonding; a plurality of image formation sections which are located downstream of the dyeing layer formation section in the revolving direction of the recording intermediate belt, and which transfer dyes of different colors to the dyeing layer formed on the outer surface of the recording intermediate belt to form a color image; an image transfer section for transferring the dyeing layer on which an image of the image formation sections is formed to recording paper by thermocompression bonding; and a control section for outputting control signals for respectively controlling the image formation sections based on an input image signal which has been input, wherein the control section is set to calculate a processing time of an input image signal which is input for each of images to be formed, and to perform a process of an input image signal of an image having a processing time for an input image signal longer than a pre-set reference value when an image formation operation is suspended for radiating heat from a high-temperature state caused by continuously performing image formation operations.

BEST MODE FOR CARRYING OUT THE INVENTION

Hereinafter, an image forming apparatus and an image forming method according to the present invention will be described with reference to the drawings.

Figure 1:
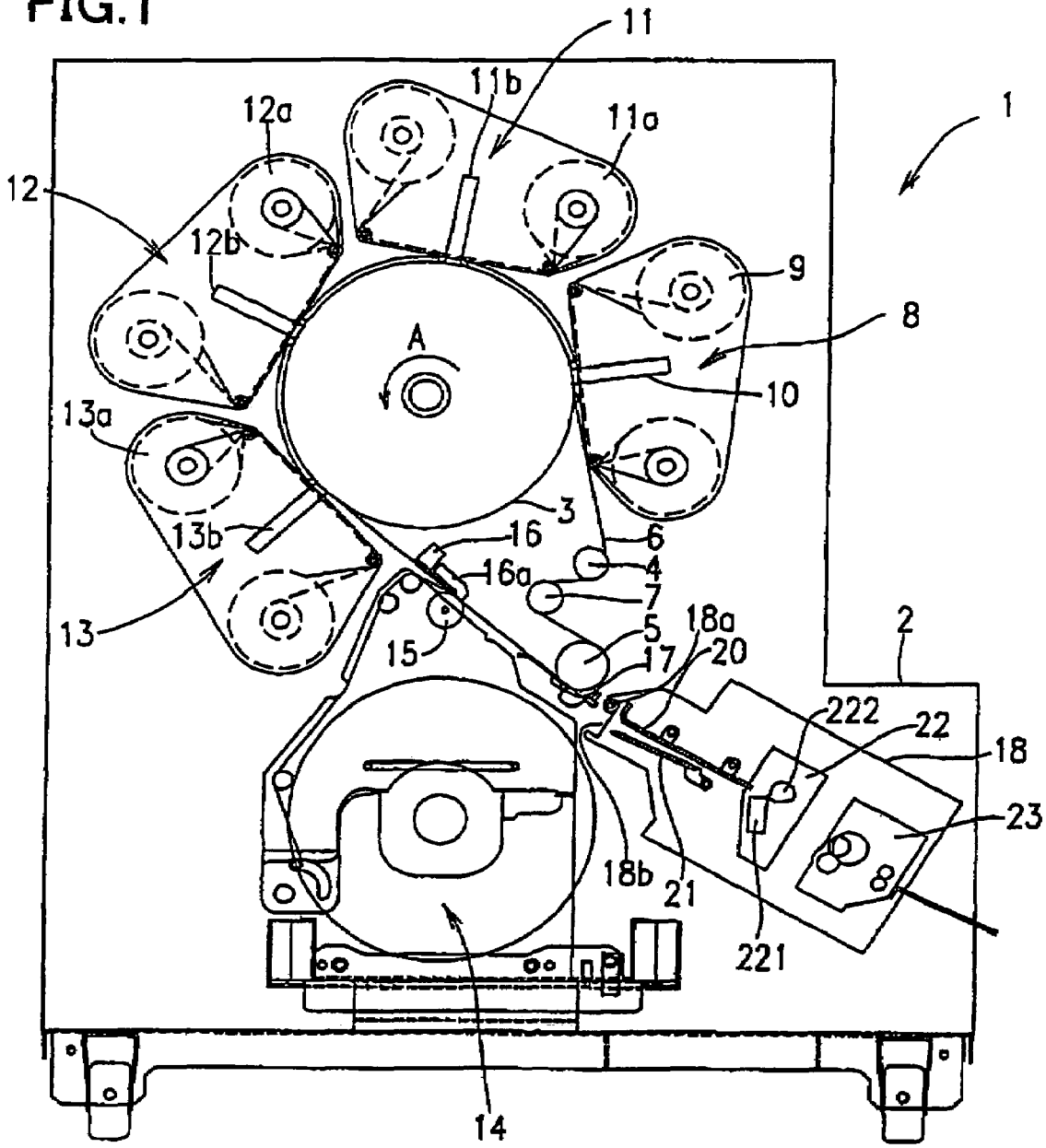
FIG. 1 is a diagram showing a structure for illustrating an overview of an image forming apparatus according to the present invention.

First, a general structure of an image forming apparatus according to the present invention will be described with reference to FIG. 1.

An image forming apparatus 1 includes a housing 2 formed to have a generally rectangular parallelepiped shape. A platen drum 3 having a large diameter is provided at nearly the center of the housing 2. The platen drum 3 is driven to rotate at a predetermined rate in a direction indicated by arrow A in FIG. 1 by a stepping motor not shown in the figure. Lower right to the platen drum 3, a sub drum 4 which is smaller than the platen drum 3 is located. Further, below the sub drum 4, an auxiliary driving roller 5 which is formed to be slightly larger than the sub drum 4 is provided.

Figure 2:
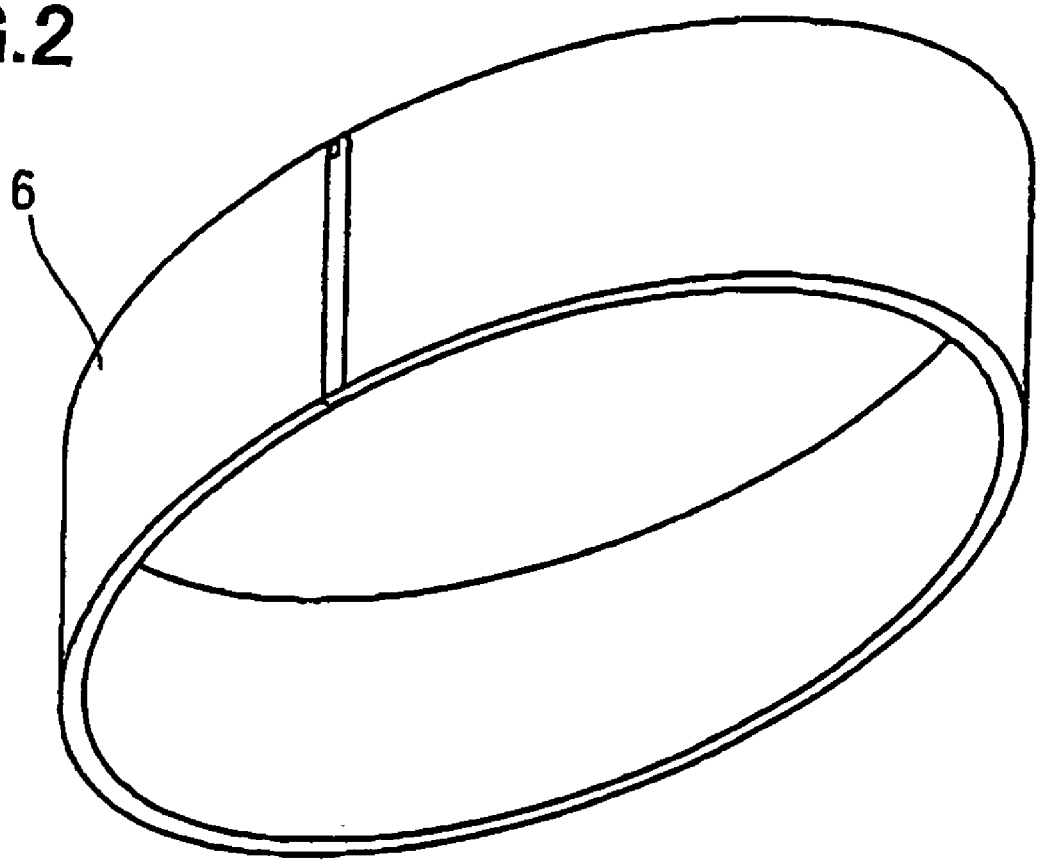
FIG. 2 is a perspective view showing a recording intermediate belt used in the image forming apparatus according to the present invention.

On outer peripheral surfaces of the platen drum 3, the sub drum 4, and the auxiliary driving roller 5, a recording intermediate belt 6 loops around them. The recording intermediate belt 6 is, for example, a belt body of a band shape which is made of a polyimide film with ends are faced and coupled to each other so that the recording intermediate belt does not have an end. FIG. 2 is a perspective view of the recording intermediate belt 6 which does not have an end obtained by coupling two ends of the belt body. However, in FIG. 2, a dimension in a thickness direction is shown to be larger than the actual dimension for the sake of simplicity of the figures.

On the outer peripheral surface of the platen drum 3, rubber having rubber hardness degree of about 60 to 70 is provided as an elastic body. When the platen drum 3 is driven to rotate in a direction indicated by arrow A by driving the stepping motor, a strong frictional force is generated between the elastic body and the recording intermediate belt 6. The recording intermediate belt 6 is formed to follow the rotary movement of the platen drum 3 and revolve.

The auxiliary driving roller 5 is formed of, for example, a torque limiter. The auxiliary driving roller 5 is rotated in the same direction as the platen drum 3 with a predetermined torque, and revolves the recording intermediate belt 6 with a constant torque.

Between the sub drum 4 and the auxiliary driving roller 5 located below the platen drum 3, a tension roller 7 for pressing the recording intermediate belt 6 in a direction from the outer periphery side toward the inside such that a constant tension is maintained with the loop recording intermediate belt 6 being prevented from slackening. The tension roller 7 is located at a pressing position for pressing the recording intermediate belt 6 from the outer periphery side when image forming operation is performed. However, the tension roller 7 is formed such that it can move to a spaced position which is spaced apart from the pressing position, where it can release tension to an extent which allows the loop recording intermediate belt 6 to be removed from the outer peripheral surface of the platen drum 3 and the like.

At the upstream side in a rotation direction of the platen drum 3, which is provided in a substantially center part of the housing 2, a dyeing layer transfer section 8 for transferring a dyeing layer on the outer peripheral surface of the recording intermediate belt 6 is provided.

In the dyeing layer transfer section 8, a dyeing transfer body roll 9, a dyeing transfer body formed by laminating the dyeing layer on a base material layer which is wound into a roll, is located. The dyeing transfer body roll 9 is located so as to face the recording intermediate belt 6 for a predetermined length, and moves in the same direction as the rotary movement direction of the recording intermediate belt 6 at the same rate. In a portion where the dyeing transfer body roll 9 and the recording intermediate belt 6 face each other, a dyeing layer transfer head 10 is provided so as to position at the side opposite to a facing side where the dyeing transfer body roll 9 and the recording intermediate belt 6 face each other.

The dyeing layer transfer head 10 has a dimension in width direction across the width direction of the recording intermediate belt 6. The dyeing layer transfer head 10 is formed to be movable between a pressing position where the dyeing transfer body roll 9 is in contact with the recording intermediate belt 6 and the dyeing transfer body roll 9 is pressed toward the recording intermediate belt 6, and a spaced position where the dyeing layer transfer head 10 is spaced apart from the dyeing transfer body roll 9 so that the dyeing transfer body roll 9 is not in contact with the recording intermediate belt 6. The dyeing layer transfer head 10 includes a heating mechanism (not shown) for thermo-compression-bonding the dyeing layer of the dyeing transfer body roll 9 on a functional layer of the recording intermediate belt 6. If the heating mechanism is driven while the dyeing layer transfer head 10 is positioned at the pressing position for pressing the recording intermediate belt 6, the dyeing layer of the dyeing transfer body roll 9 is thermo-compression-bonded to the functional layer of the recording intermediate belt 6.

At the position downstream of the dyeing layer transfer section 8 in the rotation direction of the platen drum 3, a first image formation section 11 for forming an image of yellow color on a dyeing layer formed on a surface of the recording intermediate belt 6 at the dyeing layer transfer section 8 is provided. At the position adjacent to and downstream of the first image formation section 11 in the rotation direction of the platen drum 3, a second image formation section 12 for forming an image of magenta color on the dyeing layer formed on the surface of the recording intermediate belt 6 at the dyeing layer transfer section 8 is provided. Further, at the position adjacent to and downstream of the second image formation section 12 in the rotation direction of the platen drum 3, a third image formation section 13 for forming an image of cyan color on the dyeing layer formed on the surface of the recording intermediate belt 6 at the dyeing layer transfer section 8 is provided.

The first through third image formation sections 11 through 13 respectively have a dye transfer body wound into a roll and include dye transfer cartridges 11*a* through 13*a* for pulling out the rolled dye transfer bodies. The dye transfer cartridge 11*a* through 13*a* provided in the image formation section 11 through 13 respectively pull out the wound dye transfer bodies having a roll shape so as face the recording intermediate belt 6 for a predetermined length, and moves in the direction same as the rotary movement direction of the recording intermediate belt 6 at the same rate. At portions where the dye transfer body rolls and the recording intermediate belt 6 face each other, recording heads 11*b* through 13*b* are provided on an outer periphery side with respect to the dye transfer body rolls.

The recording heads 11*b* through 13*b* respectively have dimensions in width directions almost the same as the width direction of the recording intermediate belt 6. Each of the recording heads 11*b* through 13*b* is formed to be movable between a pressing position for pressing the dye transfer body roll toward the recording intermediate belt 6 such that the dye transfer body roll is in contact with the dyeing layer on the recording intermediate belt 6, and a spaced position where the dyeing layer transfer head 10 is spaced apart from the dye transfer body roll so that the dye transfer body roll is not in contact with the recording intermediate belt 6. The recording heads 11*b* through 13*b* include heating mechanisms (not shown) for thermocompression-bonding the dyes of yellow, magenta, and cyan colors of the dye transfer body rolls to predetermined positions on the dyeing layer. Positions and concentrations of the dyes of the dye transfer body rolls to be formed on the dyeing layer on the recording intermediate belt 6 are controlled by a digital image signal and the like obtained when imaging is performed by a digital camera or the like. When the desired positions are dyed with the dyes of respective colors at the first through third image formation sections 11 through 13, a full-color image based on the dyes of yellow, magenta, and cyan color is formed on the dyeing layer.

On the dyeing layer on the recording intermediate belt 6 formed by pressing the dyeing layer transfer head 10, when the recording heads 11*b* through 13*b* of the first through third image formation sections 11 through 13 are at the pressing positions for pressing the recording intermediate belt 6, and when the heating mechanisms cause the recording head 11*b* through 13*b* generating heat, the dyes of the dye transfer body rolls are transferred to the dyeing layer. Areas of the dyeing layer to which the dyes are transferred become image formation areas for forming a predetermined image. On the other hand, even when the recording head 11*b* through 13*b* are at the pressing positions for pressing the recording intermediate belt 6, if the heads 11*b* through 13*b* are not generating heat, the dyes of the dye transfer body roll a are not transferred to the dyeing layer, and such areas of the dyeing layer become image non-formation areas. In this way, by repeating heat generation and non-heat generation of the heating mechanisms with the recording heads 11*b* through 13*b* continuously pressing the recording intermediate belt 6, the image formation areas and image non-formation areas are formed alternately on the dyeing layer.

At the position adjacent to and downstream of the third image formation section 13 in the rotation direction of the platen drum 3, a recording paper roll 14 obtained by winding recording paper formed of plain paper into a roll shape is provided. The recording paper is pulled out from the bottom of the recording paper roll toward the platen drum 3. A transfer roller 15 located between the platen drum 3 and the auxiliary driving roller 5 causes the recording paper butts against the outer peripheral surface of the recording intermediate belt 6.

With the recording intermediate belt 6 being interposed therebetween, an image transfer section 16 is provided on the side opposite to the transfer roller 15. The image transfer section 16 transfers an image formed on the dyeing layer of the recording intermediate belt 6 to a surface of the recording paper butted against the outer peripheral surface of the recording intermediate belt 6. The image transfer section 16 includes a transfer head 16*a* for pressing the recording intermediate belt 6 toward the outer periphery. The transfer head 16*a* is formed to be movable back and forth between a pressing position where the transfer head 16*a* is in contact with the recording intermediate belt 6 and presses the recording intermediate belt 6 toward the outer periphery, and a space position where the transfer head 16*a* is spaced apart from the recording intermediate belt 6 and is not in contact with the recording intermediate belt 6. When the transfer head 16*a* is at the pressing position, the transfer head 16*a* presses the recording paper to the recording intermediate belt 6 passing between the transfer roller 15 at the outer periphery side of the recording intermediate belt 6 and the transfer head 16*a*, and pressure-bonds the dyeing layer of the recording intermediate belt 6 to a surface of the recording paper.

The recording intermediate belt 6 passed between the transfer roller 15 and the image transfer section 16 and the recording paper pressure-bonded to the dyeing layer on the recording intermediate belt 6 are guided in the same direction until they pass the auxiliary driving roller 5. With the recording intermediate belt 6 being interposed therebetween, a separation roller 17 having a diameter smaller than that of the auxiliary driving roller 5 is provided on the side opposite to the auxiliary driving roller 5. The inner periphery side of the recording intermediate belt 6 is in contact with the auxiliary driving roller 5, and the outer periphery side of the recording paper is in contact with the separation roller 17. The recording intermediate belt 6 passes through the auxiliary driving roller 5 and the separation roller 17 is revolved toward upper direction along the outer peripheral surface of the auxiliary driving roller 5. On the other hand, the recording paper is pulled out downward so as to move straight from the separation roller 17 as it is. In this way, the recording intermediate belt 6 and the recording paper which has been pressure-bonded to each other until they pass the auxiliary driving roller 5 are guided in different ways after they pass between the auxiliary driving roller 5 and the separation roller 17. The recording paper is separated from the recording intermediate belt 6. At this time, the dyeing layer formed on the recording intermediate belt 6 is transferred to the recording paper, and a desired image to formed on the recording paper.

At a position downstream of the auxiliary driving roller 5 in the movement direction of the recording paper, a cutter unit 18 for cutting the recording paper to be carried is provided. When the recording paper to which an image is transferred and which moves straight downward passes the cutter unit 18 by a portion of an area in which the image is formed, a stationary blade and a rotary blade provided in the cutter 18 are driven, and the recording paper is cut in every predetermined portion. The recording paper is carried outside and removed from the housing 2.

When the above-described image forming apparatus 1 is used for forming image, images having the image quality comparable to that of color pictures using a photograph development technique can be formed. However, the recording intermediate belt 6 which loops around the platen drum 3 and revolves may suffer from the load change since pressing or the like may be performed in the sections while forming the image. When such a load change occurs, unintended stripe lines may be formed in the image to be formed, and thus the image quality may be degraded. Thus, it is important to have a structure which does not cause such a load change, or a structure in which such a load change does affect the image quality even when it occurs in order to stably provide the image quality of a high definition.

Furthermore, in the above-described image forming apparatus, if the recording paper is out by the cutter unit 18 while the first through third image-formation sections 11 through 13 perform operations for forming images on the dyeing layer, the load change which occurs when the recording paper is cut affects image formation of the first through the third image formation sections 11 through 13, and thus the image quality is deteriorated, for example, stripe lines are formed in the images to be formed. Therefore, a plurality of images cannot be continuously formed at the same time, and the efficiency of image formation cannot be promoted.

Further, in the above-described image forming apparatus, if the size of the image to be formed increases, longer time is required as image process operation time for generating a control signal for forming the image. If image formation cannot be made in time due to the image process operation time, a blank image may be formed. Thus, the efficiency of image formation cannot be promoted.

Hereinafter, regarding Embodiments 1 through 7, image forming apparatuses having a structure for overcoming such disadvantages will be described with reference to the drawings.

EMBODIMENT 1

In Embodiment 1, an image forming apparatus having a structure in which a load change due to joints of a recording intermediate belt 6 does not have an influence will be described.

As described above, the recording intermediate belt 6 used in the image forming apparatus 1 is formed without an end by coupling ends of the belt body having a band shape. Thus, when a seam of the recording intermediate belt 6 passes by the dyeing layer transfer head 10 of the dyeing layer formation section 8 or the recording heads 11*b* through 13*b* of the image formation sections 11 through 13, if the dyeing layer transfer head 10 or the recording heads 11*b* through 13*b* press the seam portion, a load change occurs in the platen drum 3. If an image is formed at another image formation section at the time, image quality thereof is degraded due to an influence of the load change.

In the image forming apparatus 1 of Embodiment 1, the recording heads 11*b* through 13*b* of the image formation sections 11 through 13 and the dyeing layer transfer head of the dyeing layer formation section 8 (hereinafter, the recording head of the image formation sections and the transfer head of the dyeing layer formation section are imply referred to as heads when they are collectively referred to) are respectively located such that they are in equal interval P. Interval P between the heads is length K of an entire circumference of the recording intermediate belt 6 divided equally by n (n is integer). That means, $K=n\times P$.

Further, pitches of image formation areas formed by transferring dyes to the dyeing layer formed on the surface of the recording intermediate belt 6 are made equal to the interval P between the heads. Further, given that the position of the seam of the recording intermediate belt 6 is origin O, images are formed in areas except for the portions at origin O and at a distance of 1×P, 2×P, . . . (n−1)×P from origin O.

Figure 3:
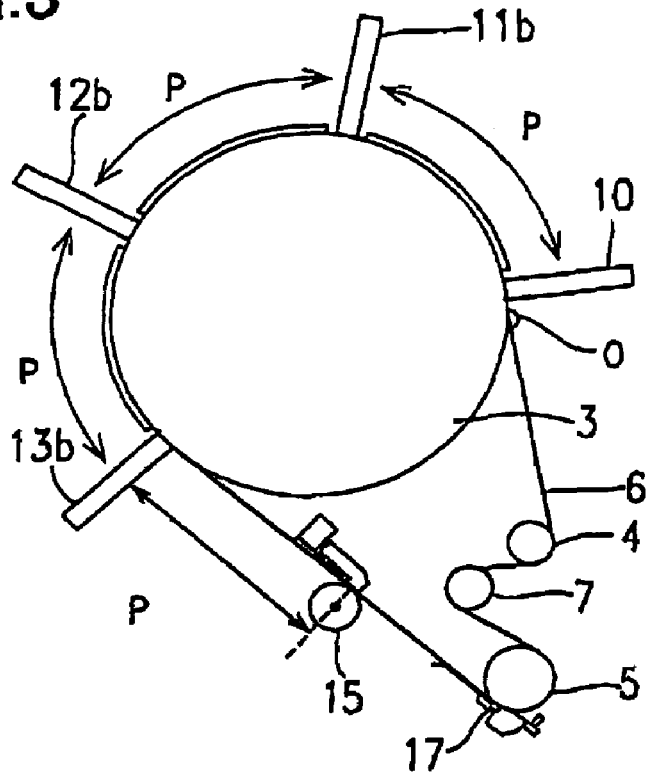
FIG. 3 is a schematic view for illustrating an image forming apparatus of Embodiment 1.

FIG. 3 is a schematic view showing the heads and image formation areas located as described above with respect to the length K of the entire circumference of the recording intermediate belt 6 and position of the seam O.

When the heads and image formation areas are located as shown in the figure, even when the seam O passes by the recording heads 11*b* through 13*b* of the first through third image formation sections 11 through 13 or the dyeing layer transfer head 10 the dyeing layer transfer section 8, image non-formation areas in the recording intermediate belt 6 are passing by other heads and operations such as forming images are not performed by other heads as shown in FIG. 3. Thus, a load change which occurs when the seam O passes by the heads does not affect image formation. As a result, by locating the heads and image formation areas an described above, the deterioration of the image quality of the image to be formed by the image forming apparatus 1 such as stripe lines can be prevented.

Figure 4:
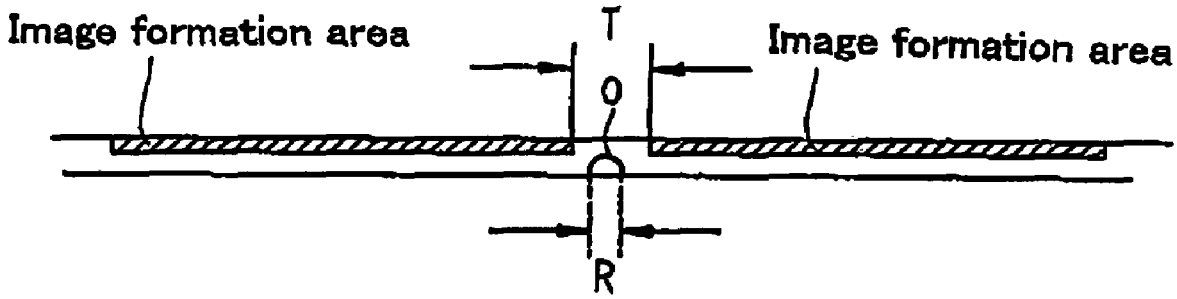
FIG. 4 is a schematic view for illustrating an example in which image formation areas are located such that length T of image non-formation areas formed between the image formation areas to larger than dimension R of a seam portion.

Furthermore, in addition to the above-described arrangement, the image formation areas are located such that length T of the image non-formation areas formed between the image formation areas becomes larger than the dimension R of the seam portion as shown in FIG. 4. This ensures to avoid influence of the load change when the seam O passes by the heads.

Figure 5:
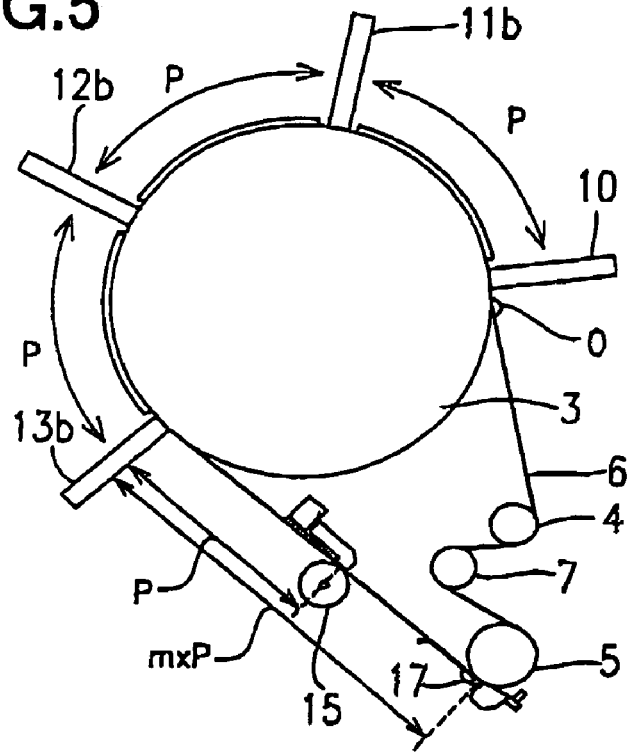
FIG. 5 is a schematic view showing another image forming apparatus of Embodiment 1.

Further, a load change due to the seam O being formed in the recording intermediate belt 6 may also occur when the seam O passes by the separation roller 17. Therefore, the separation roller 17 is located at a distance of m×P from the head portions as shown in FIG. 5 so that the load change does not affect the image quality. In this way, it is possible to prevent the image from being affected due to the load change when the seam O passes by the separation roller 17.

Figure 6:
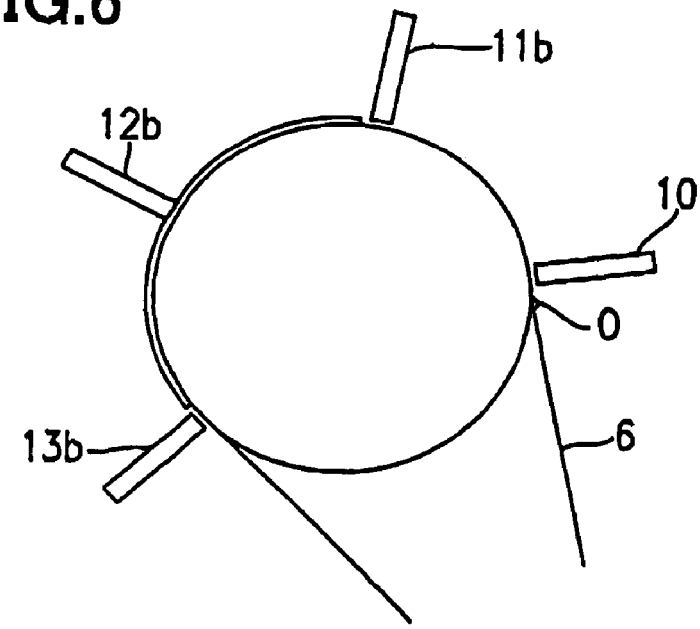
FIG. 6 is a schematic view showing an example in which, when a seam O of the recording intermediate belt passes by one of the heads, image formation areas pass by other heads.

In the image forming apparatus of Embodiment 1, the length of the image formation areas are set to be within the interval P between the heads. Thus, it to possible to ensure that the non-image forming areas are passing by all the heads whenever the seams of the recording intermediate belt 6 pass by the heads. However, if the length of the image to be formed is larger than the interval P between the heads, for example, If the length of the images is 2×P, an image formation area may pass by another head when the seam O of the recording intermediate belt 6 is passing by one of the heads. FIG. 6 shows such an example. In this example, when the seam O of the recording intermediate belt 6 passes by the dyeing layer transfer head 10 of the dyeing layer transfer section 8, the recording head 12*b* of the second image formation section 12 is pressing the recording intermediate belt 6 to form an image. A load change occurred at the dyeing layer transfer head 10 causes a stripe line in formation of magenta color image at the recording head 12*b* of the second image formation section 12, and the image quality is deteriorated.

As described above, in the case where an image longer than the period between the heads is formed, if all of the image formation operations are performed while the recording intermediate belt 6 revolves around once, they may be affected by the load change occurred when the seams of the recording intermediate belt 6 passes by the head portions. In such a case, if the image formation is performed with revolving the recording intermediate belt 6 for a plurality of times, it becomes possible that the load change occurred when the seams of the recording intermediate belt 6 passes by the head portions do not affect the image formation. For example, the dyeing layer transfer head 10 of the dyeing layer transfer section 8 presses to form the dyeing layer of the recording intermediate belt 6 in the first lap of the revolving movement of the recording intermediate belt 6. At this time, the recording head 11*b* through 13*b* of the first through third image formation sections 11 through 13 and the transfer head 16*a* of the image transfer section 16 are at the positions spaced apart from the recording intermediate belt 6. Then, in the second lap of the revolving movement of the recording intermediate belt 6, the dyeing layer transfer head 10 and the transfer head portion 16*a* of the image transfer section 16 are at the positions spaced apart from the recording intermediate belt 6, and the recording heads 11*b* through 13*b* of the first through third image formation sections 11 through 13 are at the positions for pressing the recording intermediate belt 6 to dye the dyeing layer formed on the recording intermediate belt 6 with dyes of each color and form an image. Thereafter, in the third lap of the revolving movement of the recording intermediate belt 6, the dyeing layer transfer head 10 and the recording heads 11*b* through 13*b* of the first through third image formation sections 11 through 13 are at the positions spaced apart from the recording intermediate belt 6, and the transfer head 16*a* of the image transfer section 16 is at the pressing position for pressing the recording intermediate belt 6 to transfer the image formed on the dyeing layer of the recording intermediate belt 6 to the recording paper. In this way, by performing image information over a plurality of times of revolving movement, it becomes possible that the load change occurred when the seam O of the recording intermediate belt 6 does not affect the image formation.

EMBODIMENT 2

In Embodiment 2, an image forming apparatus having a structure for avoiding defective image formation at the seam portion of the recording intermediate belt 6.

As described above, the recording intermediate belt 6 used in the image forming apparatus 1 is formed without an and by coupling the ends of the belt body having a band shape. Thus, the seam portion of the recording intermediate belt 6 has a thermal conductivity different from that of other portions of the recording intermediate belt 6. If the dyeing layer is formed on the seam portion, and the recording heads 11*b* through 13*b* are pressed to this portion to dye with the dyes of each color, the image quality of this portion becomes different from the image quality of other portions. Thus, in order to form high-definition images, the seam portion should not be included in the image formation areas.

Figure 7:
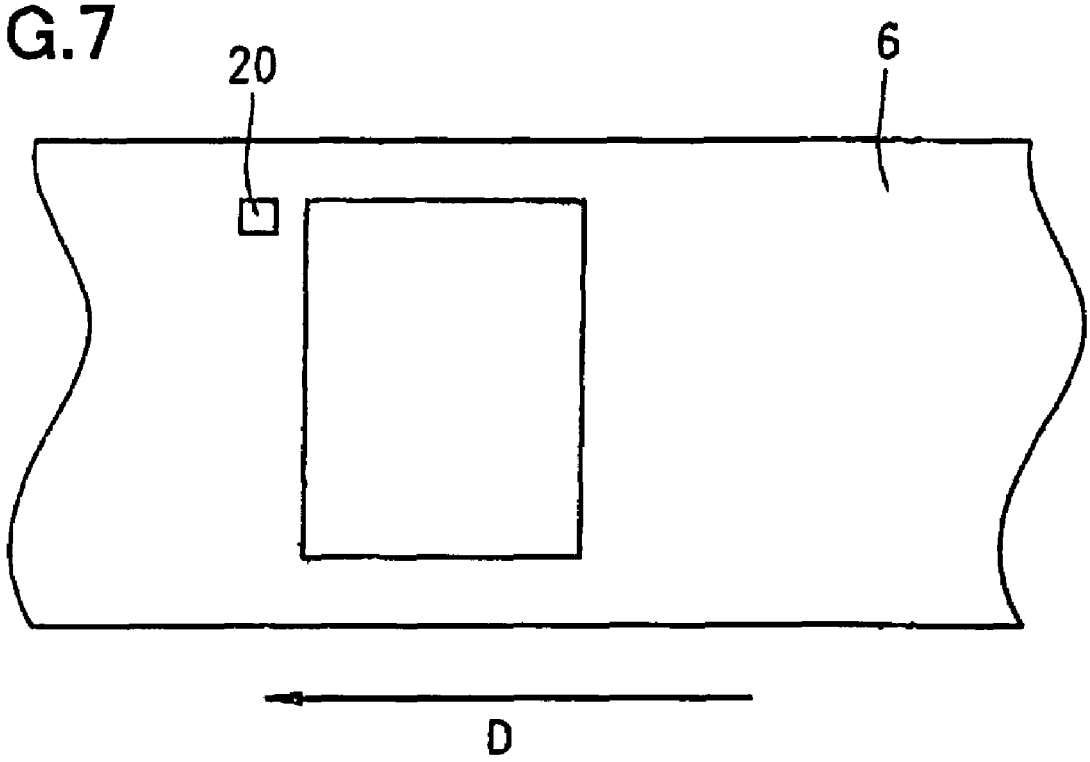
FIG. 7 is a schematic view showing the recording intermediate belt with a mark being printed near and upstream of the seam of the recording intermediate belt in a revolving direction.
Figure 8:
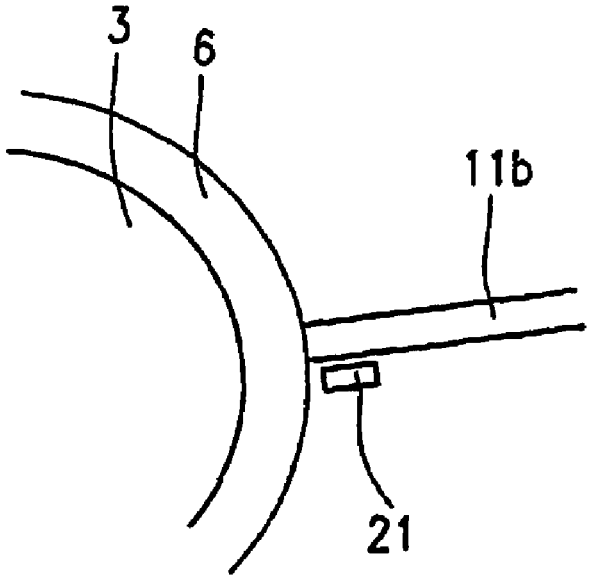
FIG. 8 is a schematic view showing an image forming apparatus of Embodiment 2 with a sensor being provided near a dyeing layer transfer head.

In the image forming apparatus 1 of Embodiment 2, as shown in FIG. 7, a mark 20 is printed at the position near the seam formed in the recording intermediate belt 6 in the revolving movement direction (indicated by arrow D in the figure). One of the dyeing layer transfer head 10 of the dyeing layer formation section 8 and the recording heads 11*b* through 13*b* of the first through third image formation sections 11 through 13, for example, the recording head 11*b* of the first image formation section 11 as shown in FIG. 8, includes a sensor 21 which can detect the mark 20 printed on the recording intermediate belt 6 at the position near the dyeing layer transfer head 10 in the revolving movement direction of the recording intermediate belt 6. By having the sensor 21 detect the mark 20 printed on the recording intermediate belt 6, the seam formed in the recording intermediate belt 6 at monitored. In the image forming apparatus 1, when the mark 20 to detected by the sensor 21, it is identified that the seam is near the dyeing layer transfer sections 10 or the like. Driving of the heads toward the recording intermediate belt 6 is interrupted. Driving of the heads is resumed after the seam has passed by the head portions. In this way, the dyeing layer and images are not formed on the seam portion of the recording intermediate belt 6. As a result, images are not formed at the positions corresponding to the seam, and it becomes possible to stably form normal images.

EMBODIMENT 3

In Embodiment 3, an image forming apparatus having a structure which allows skipping a time required for starting image formation while avoiding defective image formation at the seam portion of the recording intermediate belt 6.

As described above, the recording intermediate belt 6 used in the image forming apparatus is formed without an end by coupling the ends of the belt body having a band shape. Thus, the seam portion of the recording intermediate belt 6 has a thermal conductivity different from that of other portions of the recording intermediate belt 6. If the dyeing layer is formed on the seam portion, and the recording heads are pressed to this portion to dye with the dyes of each color, only the image quality of this portion changes. Thus, in order to form high-definition images, the seam portion should not be included in the image formation areas.

In the image forming apparatus 1 of Embodiment 3, the recording intermediate belt 6 it revolved by driving the platen drum 3 to rotate all the time to identify the position of the seam. In this way, the seam portion of the recording intermediate belt 6 is not included in the image formation areas, and the time required for confirming the position of the seam can be omitted. Therefore, when the image formation operation is started, the image formation can be started immediately without requiring an extra time from the position which does not overlap the seam O.

Figure 9:
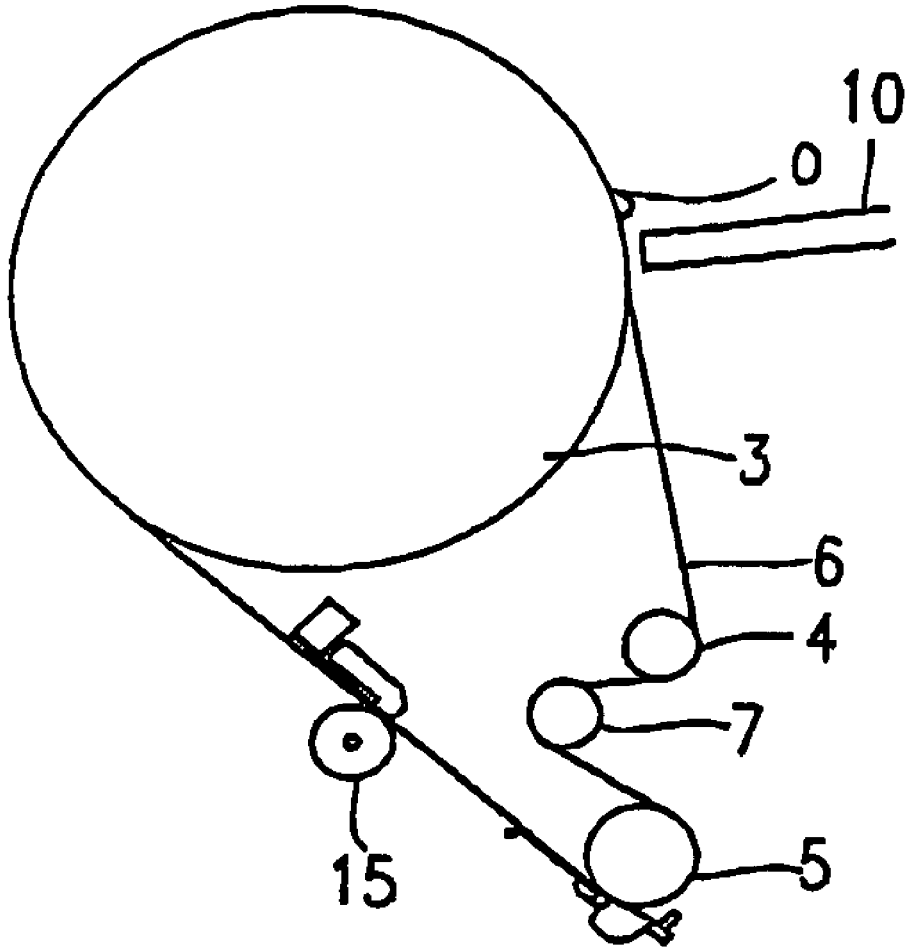
FIG. 9 is a schematic view showing an image forming apparatus of Embodiment 3.

Further, in order to identify the seam of the recording intermediate belt 6, instead of revolving the recording intermediate belt 6 all the time, the position of the seam O of the recording intermediate belt 6 may be previously identified before the image formation operation is started, and the recording intermediate belt 6 may be stopped such that the position of the seam O is near the dyeing layer transfer head 10 of the dyeing layer transfer section 8 as shown in FIG. 9. In this way, formation of images can be driven to be started immediately without requiring a time.

For identifying the seam formed in the recording intermediate belt 6, the above-described image forming apparatus of Embodiment 2 can be used. When the image forming apparatus of Embodiment 2 is used, the sensor provided near the dyeing layer transfer head 10 of the dyeing layer transfer section 8 can detect the mark on the recording intermediate belt 6. Thus, the seam portion can be identified easily. However, in Embodiment 3, other methods may be used for identifying the seam portion, for example, the position of the seam may be identified by detecting a load change which occurs when the seam portion passes by the head portions.

EMBODIMENT 4

In Embodiment 4, an image forming apparatus having a structure for preventing deterioration of the image quality due to color misalignment produced by a deviation in the positions where the recording heads 11*b* through 13*b* of the first through the third image formation sections 11 through 13 are provided.

In the image forming apparatus 1 using the heat transfer method, images are formed by pressing the dye transfer bodies of each color by using the recording heads 11*b* through 13*b* of the first through the third image formation sections 11 through 13. Thus, when there is positional deviation in the positions where the recording heads 11*b* through 13*b* are provided, color misalignment is produced in the image to be formed. However, it is very difficult to precisely adjust the recording heads 11*b* through 13*b* of the first through the third image formation sections 11 through 13 to the designed values when the image forming apparatus to produced.

In the image forming apparatus 1 of Embodiment 4, after the image forming apparatus 1 is produced with the recording heads 11*b* through 13*b* of the first through the third image formation sections 11 through 13 being arranged so as to face the outer peripheral surface of the recording intermediate belt 6, and the like, positional deviation from the designed values for the recording heads 11*b* through 13*b* of the first through the third image formation sections 11 through 13 are measured. Then, based on the measured result, recording timings for the recording heads 11*b* through 13*b* are compensated so as to absorb the deviation from the designed values. In this way, images without color misalignment can be formed without performing a precise positioning of the recording heads 11*b* through 13*b* of the first through the third image formation sections 11 through 13 when the image forming apparatus 1 is fabricated.

Next, another example of the image forming apparatus 1 of Embodiment 4 will be described. As described above, in the image forming apparatus 1, the first through the third image formation sections 11 through 13 are provided for one platen drum 3 at a plurality of positions, and operations for forming images are formed at a plurality of positions around the revolving recording intermediate belt 6 at the same time. However, when the recording heads 11*b* through 13*b* of the first through the third image formation sections 11 through 13 press the recording intermediate belt 6, the applied pressure cause the platen drum 3 to move in the pressed direction. Amounts of shift in recording positions generated by such small changes in the platen drum 3 caused by being pressed by the recording heads 11*b* through 13*b* the may vary at different positions of the platen drum 3, depending upon the pressing states of the recording heads 11*b* through 13*b*. For example, the amount of shift in the recording position of the platen drum 3 is different for the case where only one of the recording heads 11*b* through 13*b* of the first through the third image formation sections 11 through 13 presses the recording intermediate belt 6 for forming an image, and the case where all the recording heads 11*b* through 13*b* of the first through the third image formation sections 11 through 13 are pressing the recording intermediate belt 6. When there is such an amount of shift in recording positions generated by small changes in the platen drum 3, color misalignment may occur in the image to be formed.

In the image forming apparatus 1 of Embodiment 4, after the fabrication is finished, the amounts of shifts in the recording positions generated by small changes in the platen drum 3 caused by being pressed by the recording heads 11*b* through 13*b* of the first through the third image formation sections 11 through 13 provided at the respective positions of the recording intermediate belt 6 are measured previously. Based on the measured results, recording timings of the recording heads 11*b* through 13*b* are compensated. Accordingly. In the image forming apparatus 1, images without color misalignment can stably formed irrespective of the pressing states of the recording heads 11*b* through 13*b* of the first through the third image formation sections 11 through 13 provided across a plurality of areas on the outer surface of the recording intermediate belt 6.

Next, still another example of the image forming apparatus 1 of Embodiment 4 will be described.

In the image forming apparatus 1 employing the heat transfer method, a rate of forming images on the recording intermediate belt 6 can be adjusted by changing a rotation rate of the platen drum 3. However, when the rotation rate of the platen drum 3 is thus changed, a shift in the positions at which the recording heads 11*b* through 13*b* of the first through the third image formation sections 11 through 13 perform recording operations on the recording intermediate belt 6 is generated. Thus, color misalignment occur among the colors in the image to be formed.

In the image forming apparatus 1 of this example, compensation of the recording timings of the recording heads 11*b* through 13*b* of the first through the third image formation sections 11 through 13 is performed in accordance with the amounts of shifts in the recording positions of the recording heads 11*b* through 13*b* of the first through the third image formation sections 11 through 13 corresponding to the change in the rotation rate of the platen drum 3. In this way, in the image forming apparatus 1, images without color misalignment can be stably formed even when the rotation rate of the platen drum 3 is changed.

EMBODIMENT 5

In Embodiment 5, an image forming apparatus having a structure which allows alleviating a load change which occurs when recording paper with images being formed by transferring a dyeing layer is out into pieces having a desired size.

Figure 10:
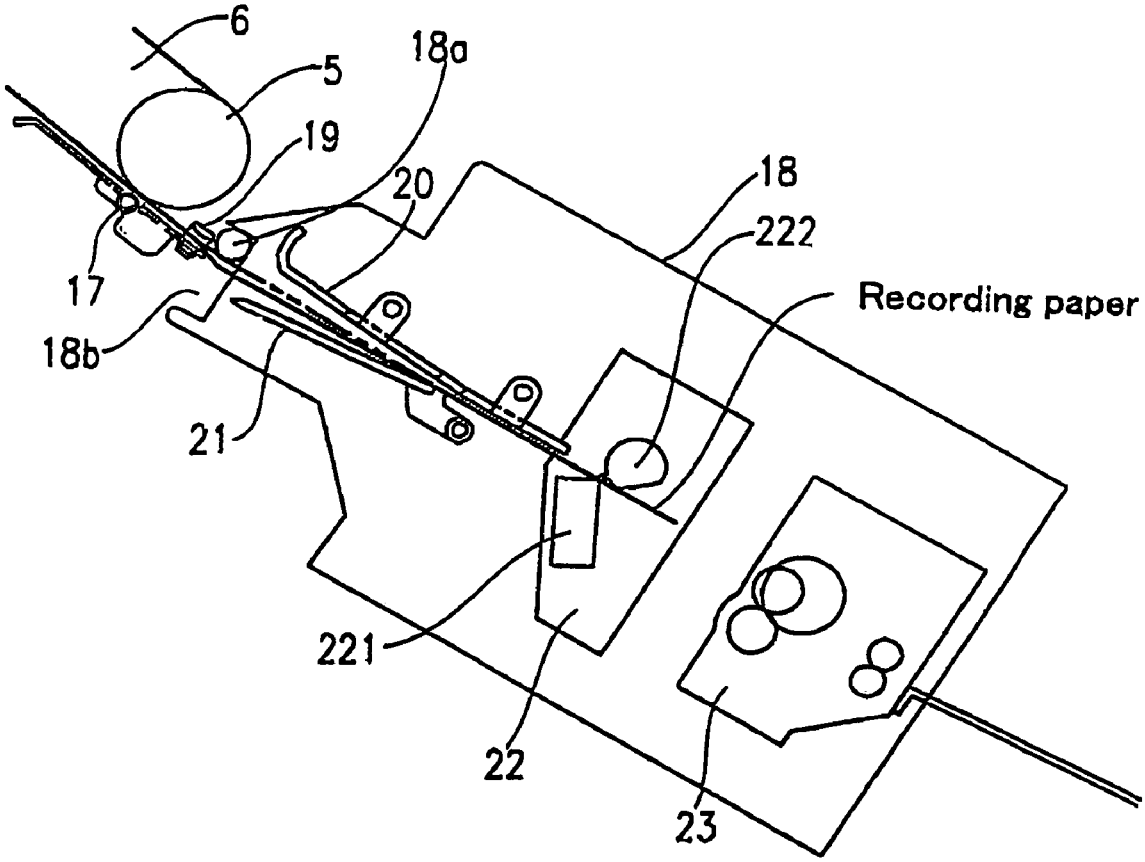
FIG. 10 is a schematic view for illustrating a cutter unit used in an image forming apparatus of Embodiment 5.

FIG. 10 to a schematic diagram illustrating a general structure of a cutter unit 18 and portions near the cutter unit 18 in the image forming apparatus of Embodiment 5. The cutter unit 18 cute the recording paper on which the dyeing layer is transferred and an image is formed after the recording paper is separated from the recording intermediate belt 6.

As shown in FIG. 10, the image forming apparatus of Embodiment 5 is formed such that recording paper pulled out from between the auxiliary driving roller 5 and the separation roller 17 passes a paper guide 19 located adjacent to and rearward of the auxiliary driving roller 6 and the separation roller 17, and is led to the cutter unit 18.

The cutter unit 18 includes: a first cutter 22 which has a stationary blade 221 and a rotary blade 222 located so as to oppose each other with the recording paper interposed therebetween and cuts the recording paper in a direction perpendicular to the direction of movement of the recording paper; and a second cutter 23 which cuts the recording paper along the direction of movement of the recording paper. The recording paper which has passed by the paper guide 19 is guided into the cutter unit 18 from a recording paper entrance 18*b* of the cutter unit 18, and sequentially passes by the first cutter 22, and the second cutter 23. The first cutter 22 cuts the guided recording paper along the direction perpendicular to the direction of the movement of the recording paper such that the image areas formed on the recording paper are separated from each other. The second cutter 23 cut the guided recording paper so as to cut off edge portions of the recording paper where images are not formed.

In the recording paper entrance 18*b* of the cutter unit, a guide roller 18*a* which is located 80 as to allow the recording paper guided into the cutter unit 18 moves smoothly, is provided. Further, a lower paper guide 21 located in a downward direction of the recording paper and an upper paper guide 20 located in upward direction of the recording paper are provided between the recording paper entrance 18*b* and the first cutter 22.

In the image forming apparatus of Embodiment 5, the guide roller 18*a*, the-upper paper guide 20, and the lower paper guide 21 are respectively located so as to have a space to allow the recording paper passing through the cutter unit 18 to bend as indicated by a solid line in the figure between the recording paper entrance 18*b* and the first cutter 22.

In FIG. 10, the double-dotted line indicates the state of the recording paper in the conventional image forming apparatus, which is formed not to generate a bent in the recording paper until it reaches the cutter unit 18, for the purpose of comparison.

In the image forming apparatus of Embodiment 5, the recording paper pulled out from between the auxiliary driving roller 5 and the separation roller 17 bends until it reaches the first cutter 22 in the cutter unit 18. This bent absorbs cutting shocks when the recording paper is out by the first cutter 22, and it can be prevented that the cutting shock affects the image formation at each of the image formation sections. Thus, even though the operations to form a plurality of images are continued at the same time using the image forming apparatus of Embodiment 5, the image quality of the images to be formed does not deteriorate, and the efficiency of the image formation can be promoted.

EMBODIMENT 6

In Embodiment 6, an image forming apparatus having a structure for preventing formation of a blank image because it takes a long time to generate a control signal used for forming images at respective image formation sections.

For forming images using the image forming apparatus 1 having the above-described structure, a control device which is not shown in the figure and is not explained generates a control signal for controlling each of the image formation sections based on an input image signal which has been input. Based on the control signal generated by the control device, a desired image can be obtained from the first through the third image formation sections 11 through 13. When the size of the image to be formed is not large, the image process operation time for generating the control signal does not take a long time. The time for generating a control signal becomes about the same as or shorter than the image formation time required for forming images by the image formation section. Thus, generation of the control signal can be finished by the time the formation of the images is started by the image formation sections 11 through 13. Therefore, the control signal can be generated in time even when a plurality of images are formed, and thus, there is no problem in image formation.

However, when the images to be formed include an image having a large size, and when a plurality of images with a large size are in series, it takes a long time to generate a control signal for forming the images, and there may be a case where the control signal cannot be generated in time by the time the first through the third image formation sections 11 through 13 start the image formation. When the control signal cannot be generated in time, the control signal is not input to the image formation sections 11 through 13, and the blank image with no image being formed is generated. This portion becomes a waste, and thus, efficiency of image formation cannot be promoted.

In the image forming apparatus 1 of Embodiment 6, for forming the continuous images, processing time of the input image signals which are input for every image to be formed are respectively calculated, and the order for forming the images are set based on the calculated result. For example, when a plurality of images which have large size and require a long time for generating a control signal are included in the images formed at the image formation sections 11 through 13, the order for forming the images are adjusted to avoid that the images having the large size are formed in series and to form the image with a small size so as to sandwich the image with the large size. In this case, regarding whether it takes a long time or not for forming the control signal is preset, a predetermined reference value is preset.

In the image formation, there is a correlation between the size of the image to be formed and the processing time required for generating the control signal. Table 1 below shows an example of such a correlation between the image size and the processing time. Such data is previously stared in the control device. For example, it is assumed that the time for forming images at the image formation sections 11 through 13 is 7 seconds. As the processing time for the input image signals having the image size of 3040×2280 or larger in the example shown in Table 1 exceeds 7 seconds, if the images having such image size are in series, the control signal cannot be generated in time and a blank image is produced Thus, the order for forming images is determined such that the images having such an image size are not formed in series.

TABLE 1

Image Size and Processing Time

| Size (dot) | Time (sec) |
|---|---|
| 5048 × 3568 | 13.1 |
| 3040 × 2280 | 7.2 |
| 2400 × 1800 | 6.5 |
| 1600 × 1200 | 4.5 |
| 1024 × 768 | 4.0 |
| 800 × 600 | 2.7 |
| 640 × 480 | 2.4 |
| 400 × 300 | 2.2 |

Figure 11:
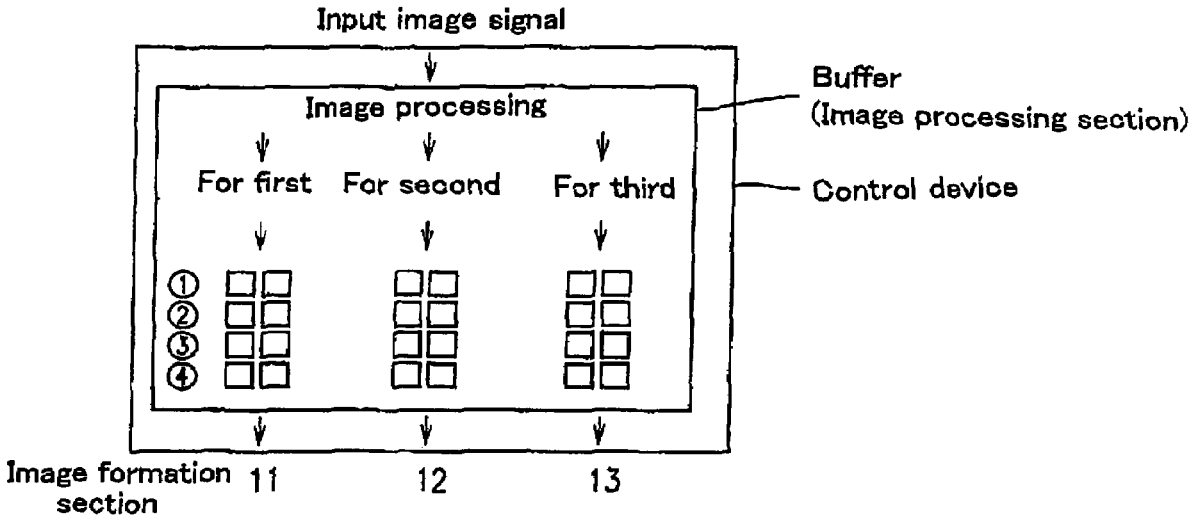
FIG. 11 is a diagram schematically showing an actual example of forming a control signal using a plurality of buffers in an image forming apparatus of Embodiment 6.

FIG. 11 is a schematic figure showing an actual example of forming control signals using a plurality of buffers. In this example, every time four input images signals are input into buffers of the control device, the order of the image processing is determined. Among the four input image signals which has been input into the buffers, for example, when two input image signal exceed the image formation time at the image formation sections 11 through 13, these input image signals are made not to be processed in series. For example, control signal formation processing for those signals are performed first and third. Process for other input image signals are put to second and fourth.

If the images with a small size cannot be located to sandwich the image with a large size, the control signal of the image with a large size is previously generated and stored in the buffer of the control device before the image formation is started. Thus, even when an image with a large size which require a long time for generating the control signal is included, control signals of the image with a small size generated in forward and rearward direction, which does not require along time to generate the control signals, are generated. The image process operation time for forming the images can be made uniform. Thus, the control signals can be generated in time by the time when the formation of the images are started at the image formation sections 11 through 13. The formation of a blank image can be prevented. As a result, a blank image with no image being formed is not generated, and thus, the efficiency in the image formation can be promoted.

EMBODIMENT 7

In Embodiment 7, an image forming apparatus having a structure for preventing formation of a blank image because it takes a long time to generate a control signal used for forming images at respective image formation sections.

For forming images using the image forming apparatus 1 having the above-described structure, a control device which is not shown in the figure and is not explained generates a control signal for controlling each of the image formation sections based on an input image signal which has been input. Based on the control signal generated by the control device, a desired image can be obtained from the first through the third image formation sections 11 through 13. When the size of the image to be formed is not large, generating the control signal does not take a long time. The time for generating a control signal becomes about the same as or shorter than the image formation time required for forming images by the image formation sections 11 through 13. Thus, generation of the control signal can be finished by the time the formation of the images is started by the image formation sections 11 through 13. Therefore, the control signal can be generated in time even when a plurality of images are formed, and thus there is no problem in image formation.

However, when the images to be formed include an image having a large size, it takes a long time to generate a control signal for forming the images, and there may be a case where the control signal cannot be generated in time by the time the first through the third image formation sections 11 through 13 start the image formation. When the control signal cannot be generated in time, the control signal is not input to the image formation sections 11 through 13, and the blank image with no image being formed is generated by the first through the third image formation sections 11 through 13. This portion becomes a waste, and thus, efficiency of image formation cannot be promoted.

In the image forming apparatus 1 of Embodiment 7, the control device is set to perform an operation process for the images which require a long time for generating the control signal by utilizing the time while the image formation operation is temporarily suspended. More specifically, when image formation operations are continuously performed for a number of sheets, the platen drum 3, the recording intermediate belt 6 and the like are overheated, which results in deterioration of the quality of the image to be formed. Thus, when the above-described image forming apparatus 1 is operated, operation has to be suspended at a regular time intervals in order to radiate heat of the platen drum 3 and the like in a high-temperature state. In Embodiment 7, such a suspended time is effectively used to perform the operation process for the images which require a long time for generating the controlling signal. In this case, cooling time is predicted based on the last cooling time, and the current temperature state and the like. The process is sequentially performed from the images with a large processing time so as to fill the buffer of the control device by the time cooling is finished. Therefore, even the remaining data of the buffer is small, the processing performed sequentially from the images with a large image size while the suspended period. In this way, even when a image which has a large size and requires a long time for generating the control signal is included, a blank image is not formed because the image formation sections 11 through 13 cannot make in time to start image formation due to generation of the control signal, or the operation of the image formation sections are not interrupted until the image process operation time is finished. Therefore, the efficiency of the image formation can be promoted.

INDUSTRIAL APPLICABILITY

As described above, in an image forming apparatus and an image forming method according to the present invention, the dyeing layer transfer head and the recording head are located in an equal interval of P, obtained by equally dividing the length K of the entire circumference of the recording intermediate belt by n (n is integer) such that a load change which may occur when the seam O passes by the heads does not affect the image formation. Given that the position of the seam of the recording intermediate belt which does not have an end obtained by coupling the ends of the belt body of a band shape is origin O, the images are to be formed in areas except for the portions at origin O and at a distance of 1×P, 2×P, . . . (n−1)×P from origin O. In this way, it is possible to prevent deterioration in the image quality, such as stripe lines in the images formed by the image forming apparatus, and the like.

In another image forming apparatus and image forming method according to the present invention, a mark is printed near the seam portion of the recording intermediate belt and detection means for detecting the mark is provided in order to avoid defective image formation at the seam portion of the recording intermediate belt. A head which includes detection means which detects the mark is interrupted from pressing the recording intermediate belt. In this way, images are not formed at the positions corresponding to the seam portion, and normal images can be stably formed.

Further, in still another image forming apparatus according to the present invention, the time required for starting the image formation is omitted while the defective image formation at the seam portion of the recording intermediate belt is avoided. For this purpose, the recording intermediate belt may be rotated all the time even when the images are not formed to identify the position of the seam of the recording intermediate belt which does not have an end obtained by coupling the ends of the belt body having a band shape. Alternatively, the position of the seam of the recording intermediate belt which does not have an end obtained by coupling the ends of the belt body having a band shape may be made to stop near the dyeing layer transfer head of the dyeing layer transfer section previously before the image formation operation is started. In this way, the image formation can be started immediately without requiring an extra time from the position which does not overlap the seam of the recording intermediate belt.

In yet another image forming apparatus according to the present invention, color misalignment due to the positional deviation of the recording heads of the image formation sections is prevented. For this purpose, the image forming apparatus has a structure in which the positional deviation of the recording heads of a plurality of image formation sections from the designed values are previously measured, and, based on the measured results, the compensation of the recording timing of the recording heads is performed so as to absorb the positional deviation from the designed value. Alternatively, the image forming apparatus has a structure such that the relationship between the pressing states of the recording heads provided at various positions of the recording intermediate belt and shifts in the recording positions due to small changes caused by being pressed by the recording heads are previously measured, and, based on the measured results, compensation of the recording timing of the recording heads is performed. In this way, the deviation in the positions where the recording heads are provided, the shift in recording position due to small change in the respective states of the platen drum being pressed by the recording heads, and the positional shift due to a change in the rate of movement of the recording intermediate belt can be prevented. Therefore, images without color misalignment can be stably formed.

In further image forming apparatus according to the present invention, the separation roller and the cutting means are located such that the recording paper bends between them to an extent that a load change which occurs when the recording paper is cut by the cutting means is absorbed. In this way, the load change which occurs when the recording paper is cut by the cutting means can be prevented from affecting the image formation at the image formation sections. Therefore, even when the operations to form a plurality of the images are continued at the same time, the image quality of the images to be formed is not deteriorated, and the efficiency of the image formation can be promoted.

In another image forming apparatus according to the present invention, the image formation section, which outputs the control signal which respectively controls the image formation sections based on the input image signal which has been input, calculates the processing time for the input image signals which are input for every image to be formed and, based on the calculation results, set the order to form the images for continuously forming images. In this way, even when a plurality of images which require a long time for generating the control signal are included, the control signals can be generated by the time image formation is started, and a blank image with no image being formed can be prevented. Thus, the efficiency of the image formation can be promoted.

Further, in still another image forming apparatus according to the present invention, the control section, which outputs the control signal which respectively controls the image formation sections based on the input image signal which has been input, calculates the processing time for the input image signals which are input for every image to be formed, and set the processing of the input image signal for the image which has a processing time longer than the pre-set reference value to be performed when the image formation operation is suspended from radiating the heat in the high-temperature state due to performing the image formation operation continuously. In this way, even when an image which require a long time for generating a control signal is included, a blank image is not formed because the generation of the control signal cannot be made in time by the time the image formation operation is started due to generation of the control signal. Thus, the efficiency of the image formation can be promoted.

As described above, in the image forming apparatus and the image forming method according to the present invention, factors which may deteriorate the definition of images are previously avoided, images of a high definition can be stably formed, and the efficiency of image formation can be promoted.

The invention claimed is:

1. An image forming apparatus comprising:

a recording intermediate belt which does not have an end obtained by coupling two ends of a belt body of a band shape;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, the dyeing layer transfer head and the recording heads are located in equal interval of length P, which is obtained by equally dividing length K of the entire circumference of the recording intermediate belt by n (n is integer), the image formation section is formed, given that the position of a seam of the recording intermediate belt is origin O, to form an image in portions except for portions at origin O and at a distance of 1×P, 2×P, . . . (n−1)×P from origin O.

2. An image forming apparatus according to claim 1, wherein:

image formation areas formed by transferring dyes by the image formation sections to the dyeing layer formed on the recording intermediate belt by the dyeing layer formation section, and image non-formation areas formed by not transferring dyes by the image formation sections are repeatedly formed; and the image non-formation areas between the image formation areas are formed such that length T along the revolving direction of the recording intermediate belt is larger than length R of the seam of the recording intermediate belt.

3. An image forming apparatus according to claim 1, comprising a separation roller for separating the recording intermediate belt and the recording paper which are thermocompression-bonded via the dyeing layer at the image transfer section, wherein the separation roller is located at the position at a distance of m×P (m is integer) from the recording head of the image formation section in an upstream direction.

4. An image forming method for forming an image having a length longer than interval P between the dyeing layer transfer head and the recording heads by using the image forming apparatus according to claim 1, wherein:

an image is formed on a surface of the recording intermediate belt during a plurality of cycles of revolving movement of the recording intermediate belt; and only a predetermined head of the dyeing layer transfer head and the recording heads presses the recording intermediate belt in each cycle of the revolving movement of the recording intermediate belt.

5. An image forming method according to claim 4, wherein, for a plurality of cycles of the revolving movement of the recording intermediate belt, only the dyeing layer transfer head presses the recording intermediate belt in the first cycle of the revolving movement of the recording intermediate belt, and only the recording heads press the recording intermediate belt in the second cycle of the revolving is movement of the recording intermediate belt.

6. An image forming apparatus comprising:

a recording intermediate belt which does not have an end obtained by coupling two ends of a belt body of a band shape;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, a mark is printed near a seam of the recording intermediate belt, and detection means for detecting the mark is provided.

7. An image forming method using an image forming apparatus according to claim 6, wherein:

when the detection means detects the mark, the dyeing layer transfer head or the recording heads which includes the detection means stops pressing the recording intermediate belt.

8. An image forming apparatus comprising:

a recording intermediate belt which does not have an end obtained by coupling two ends of a belt body of a band shape;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, the recording intermediate belt revolves all the time even when it does not form an image, and a position of a seam of the recording intermediate belt is always detected, and image formation is started based on the detected results.

9. An image forming apparatus comprising:

a recording intermediate belt which does not have an end obtained by coupling two ends of a belt body of a band shape;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and before an image formation operation is started, a seam of the recording intermediate belt, which does not have an end obtained by coupling two ends of a belt body of a band shape, is previously stopped at a position near the dyeing layer transfer head of the dyeing layer transfer section.

10. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and a positional deviation from designed values of the recording heads in the plurality of the image formation sections are previously measured, and based on the measured results, compensation of recording timings of the recording head is performed so as to absorb the positional deviation from the designed values.

11. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper-by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt and relationships between pressing states of the recording heads of the recording intermediate belt and amounts of shift in recording positions due to small changes caused by being pressed by the recording heads are previously measured, and based on the measured results, compensation of recording timings of the recording heads is performed.

12. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image; and an image transfer section for transferring the dyeing layer on which an image of the image formation sections is formed to recording paper by thermocompression bonding, wherein the dyeing layer formation section includes a dyeing layer transfer head for transferring the dyeing layer to the outer surface of the recording intermediate belt by thermocompression bonding, the plurality of the image formation sections respectively include recording heads for transferring dyes of respective colors to the dyeing layer formed on the outer surface of the recording intermediate belt, and compensation of recording timings of the recording heads is performed in accordance with amounts of shift in recording positions of the recording heads of the image formation sections corresponding to a change in a rotation rate of the platen drum.

13. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt by thermocompression bonding;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image;

an image transfer section for transferring the dyeing layer on which an image of the image formation sections is formed to recording paper by thermocompression bonding;

a separation roller which is provided downstream of the image transfer section in the revolving direction of the recording intermediate belt, and which guides the recording intermediate belt and the recording paper, which are pressure-bonded to each other via the dyeing layer and moving, in different directions to separate the recording intermediate belt and the recording paper from each other; and cutting means for cutting the recording paper guided in a different direction from the recording intermediate belt by the separation roller into color images which have been formed, wherein the cutting means is located such that the recording paper bends to an extent to absorb a cutting shock generated when the recording paper is out by the cutting means.

14. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt by thermocompression bonding;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image;

an image transfer section for transferring the dyeing layer on which an image of the image formation sections is formed to recording paper by thermocompression bonding; and a control section for outputting control signals for respectively controlling the image formation sections based on an input image signal which has been input, wherein the control section calculates a processing time of an input image signal which is input for each of images to be formed when images are formed continuously, and, based on the calculated results, sets an order for forming the images.

15. An image forming apparatus according to claim 14, wherein the control section sets an order for forming images such that images having processing times for input image signals which are input are longer than a pre-set reference value are not continuously formed.

16. An image forming apparatus according to claim 14, wherein the control section performs, based on calculated results of calculation on a processing time of an input image signal which is input, a process of input image signal of an image having a processing time for an input image signal longer than a pre-set reference value before forming an image.

17. An image forming apparatus comprising:

a recording intermediate belt which does not have an end;

a platen drum and at least one roller around which the recording intermediate belt loops so as to be revolvable;

a dyeing layer formation section for forming a dyeing layer on an outer surface of the revolving recording intermediate belt by thermocompression bonding;

a plurality of image formation sections which are located downstream of the dyeing layer formation section in the revolving direction of the recording intermediate belt, and which transfer dyes of different colors to the dyeing layer formed on the outer surface of the recording intermediate belt to form a color image;

an image transfer section for transferring the dyeing layer on which an image of the image formation sections is formed to recording paper by thermocompression bonding; and a control section for outputting control signals for respectively controlling the image formation sections based on an input image signal which has been input, wherein the control section is set to calculate a processing time of an input image signal which is input for each of images to be formed, and to perform a process of an input image signal of an image having a processing time for an input image signal longer than a pre-set reference value when an image formation operation is suspended for radiating heat from a high-temperature state caused by continuously performing image formation operations.

* * * * *